US007207542B2

(12) United States Patent
Conway et al.

(10) Patent No.: US 7,207,542 B2
(45) Date of Patent: Apr. 24, 2007

(54) MOUNTING SYSTEM WITH WEDGE

(75) Inventors: Thomas M. Conway, Park Ridge, IL (US); Scott Padiak, Skokie, IL (US); Paul C. Evans, Chicago, IL (US)

(73) Assignee: Cormark, Inc., Des Plaines, IL (US)

( * ) Notice: Subject to any disclaimer, the term of this patent is extended or adjusted under 35 U.S.C. 154(b) by 252 days.

(21) Appl. No.: 10/940,366

(22) Filed: Sep. 14, 2004

(65) Prior Publication Data

US 2006/0054749 A1 Mar. 16, 2006

(51) Int. Cl.
*A47B 97/04* (2006.01)

(52) U.S. Cl. ..... 248/458; 248/220.21; 40/606.01

(58) Field of Classification Search ..... 248/110, 248/458, 240, 243, 220.21; 16/309, 311, 16/312, 316, 283, 284; 40/606.01; 411/45–48, 411/508

See application file for complete search history.

(56) References Cited

U.S. PATENT DOCUMENTS

| | | | | | |
|---|---|---|---|---|---|
| 684,721 | A * | 10/1901 | Roots | 16/313 |
| 2,100,473 | A * | 11/1937 | Ensslin | 16/316 |
| 2,144,885 | A * | 1/1939 | MacFadden | 248/222.12 |
| 3,153,975 | A * | 10/1964 | Rapata | 24/295 |
| 3,184,200 | A * | 5/1965 | McDonnell | 248/240 |
| 4,048,768 | A * | 9/1977 | Good | 52/36.6 |
| 4,391,020 | A * | 7/1983 | Hsu | 16/314 |
| 4,811,922 | A * | 3/1989 | Yoneyama | 248/73 |
| 4,909,464 | A * | 3/1990 | Levine et al. | 248/220.22 |
| 5,507,545 | A * | 4/1996 | Krysiak | 296/97.9 |
| 6,086,033 | A * | 7/2000 | Calleja | 248/240 |
| 6,202,963 | B1 * | 3/2001 | Derman | 248/110 |
| 6,371,419 | B1 * | 4/2002 | Ohnuki | 248/74.2 |
| 6,517,300 | B2 * | 2/2003 | Bentrim et al. | 411/45 |
| 6,616,479 | B1 * | 9/2003 | Jones | 439/567 |
| 6,641,093 | B2 * | 11/2003 | Coudrais | 248/73 |
| 6,698,124 | B2 * | 3/2004 | Kump et al. | 40/642.02 |
| 6,701,575 | B2 * | 3/2004 | Padiak et al. | 16/309 |
| 6,901,633 | B2 * | 6/2005 | Chen | 16/240 |
| 2004/0195483 | A1 * | 10/2004 | Padiak et al. | 248/289.11 |

* cited by examiner

*Primary Examiner*—Amy J. Sterling
(74) *Attorney, Agent, or Firm*—Welsh & Katz, Ltd.

(57) ABSTRACT

A mount for securing an associated object such as a sign to a supporting structure having wall defining an opening therein and having an outer surface and an inner surface, includes a mounting element adapted to receive the object. The mounting element has a body having an opening therein that is defined by edges. The opening has a predetermined shape. The body has a pair of resilient fingers extending rearwardly from the body. The fingers define portions of the edges of the opening in the body. A wedge has a base and a pair of resilient legs depending from the base. The wedge has a predetermined shape adapted for receipt in the body opening. The legs each have a notch formed therein. The mounting element is positioned with the resilient fingers in the supporting structure wall opening with the fingers locked to the supporting structure wall and the wedge is received in the body opening to interfere with the mounting element fingers flexing inward, securing the mounting element to the support structure.

13 Claims, 2 Drawing Sheets

MOUNTING SYSTEM WITH WEDGE

BACKGROUND OF INVENTION

It is often times desirable to mount a sign, display or other object onto a supporting structure. For example, in order to access the area behind such a sign (e.g., to restock a shelf), it is desirable to mount the sign to a structure (such as a storage rack or a pallet rack) by some type of movable or flexible arrangement. In one such arrangement, the sign is mounted to a rack by a hinge; that is, the sign is pivotally mounted to the rack by a hinge arrangement such as that disclosed in U.S. patent application Ser. No. 10/680,909 to Padiak et al., which application is commonly assigned with the present application and is incorporated herein by reference.

The hinges, however, must be adequately secured to the support structure. One way in which the hinge is secured to the supporting structure is by flexible extensions or fingers that extend rearwardly from the base or mounting portion that are snugly fitted into an opening in the supporting structure. In this arrangement, the extensions engage the sides of the opening. Barbs at the end of the fingers lock the mounting portion to the support. To disengage the mounting element, the extensions are squeezed together or the mounting portion is twisted side to side, to loosen the fingers and disengage the barbs.

However, there are drawbacks to this mounting system. For one, after repeated engagement and disengagement, the fingers can become weakened and fatigued, and as a result lose their resiliency and thus the ability to spring back after being pushed through the opening in the supporting structure. As a result, the mounting element and the object (e.g., the sign) may not be secured to the supporting structure as desired.

Accordingly, there is a need for a mounting system that secures the mounting element to the supporting structure. Desirably, such a mounting system permits installation of the mount (hinge) without the need for tools. More desirably, such a mount is readily installed and locks into place, but is also readily removed, when desired.

BRIEF SUMMARY OF THE INVENTION

A mount is configured for securing an associated object, such as a sign, to a supporting structure, which supporting structure has a wall defining an opening therein, having an outer surface and an inner surface.

The mount includes a mounting element adapted to receive the object. The mounting element has a body having an opening therein that is defined by edges and has a predetermined shape. Preferably, the opening is a rectangular opening. The body has a pair of resilient fingers that extend rearwardly from the body. The fingers define portions of the edges of the opening in the body. That is, the fingers extend rearwardly from the body at the edges of the opening. A preferred resilient finger has an inclined surface and defines a barb on the finger.

A wedge has a base and a pair of resilient legs depending from the base. The wedge has a predetermined shape and is adapted for receipt in the body opening. The mounting element is positioned with the resilient fingers in the supporting structure wall opening with the fingers locked to the supporting structure wall. The wedge is received in the body opening to interfere with the mounting element fingers flexing inward and to secure the mounting element to the support structure.

In a preferred arrangement, the wedge legs each include a channel formed therein between the base and a free end of each leg. Preferably, the legs each include an inclined surface extending from the free end and forming a lip of the channel.

In a present mount, the opening in the body is rectangular and the wedge has a rectangular cross-sectional shape for mating receipt in the rectangular opening. The fingers are disposed on opposite sides of the rectangular opening and the wedge is disposed in the opening between the fingers.

The mount can be used to mount or support, for example, a sign. One such sign is a pivoting sign in which case a pivoting portion is mounted to the mounting element. A pivot pin is used to mount the pivoting portion to the mounting element.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying figures, wherein.

DETAILED DESCRIPTION OF THE INVENTION

Figure 1:
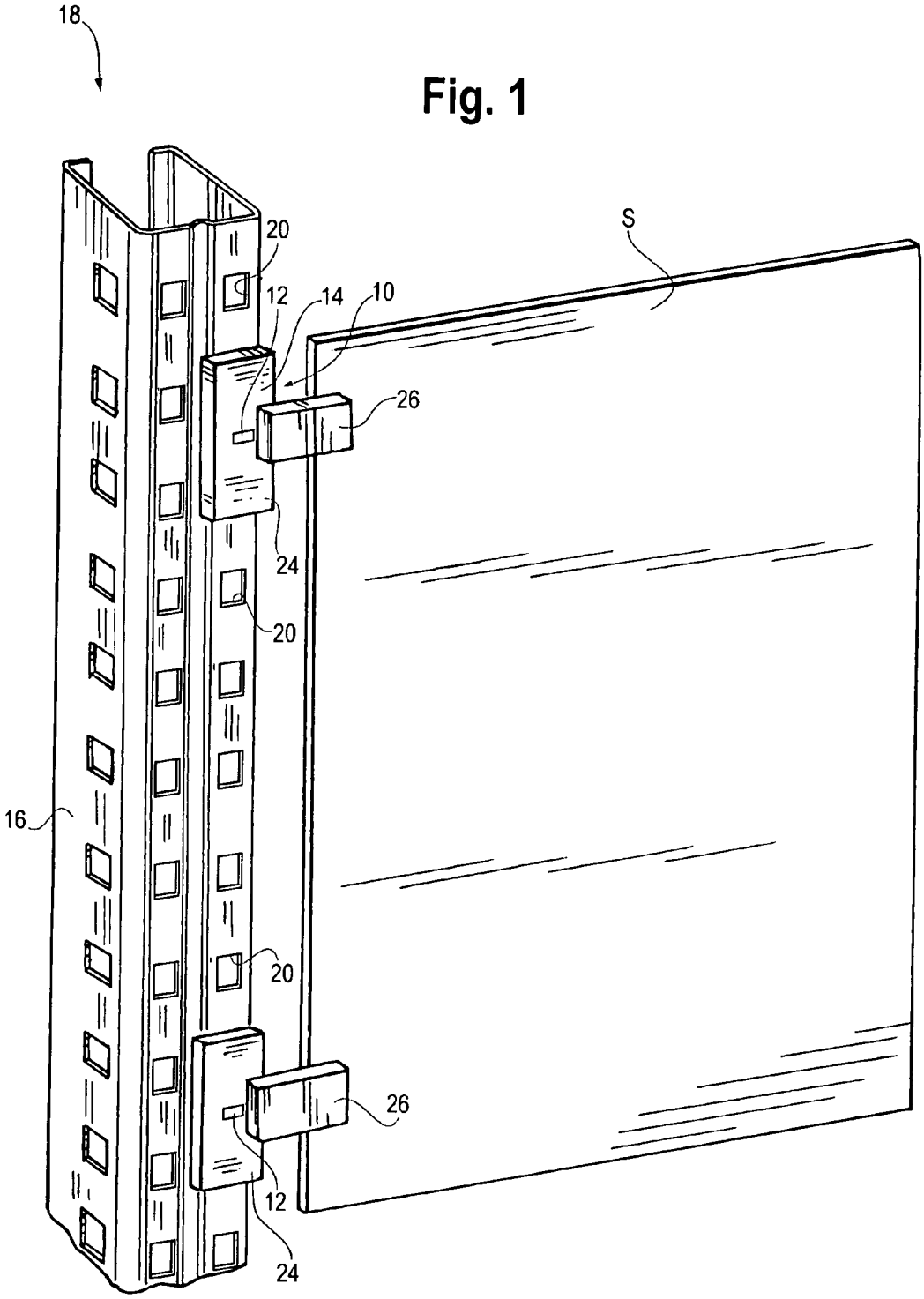
FIG. 1 is a perspective illustration of a sign mounted to a support structure (post) having a mount system with wedge embodying the principles of the present invention.
Figure 2:
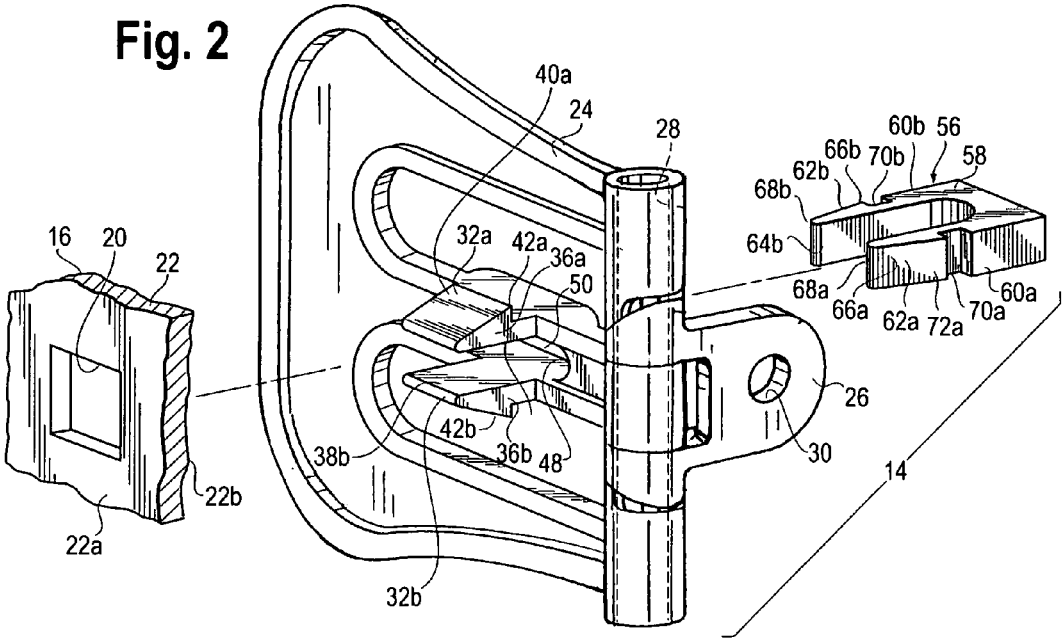
FIG. 2 is a partial perspective view of a mounting element and a wedge show in an exploded view with a portion of the support post.
Figure 3:
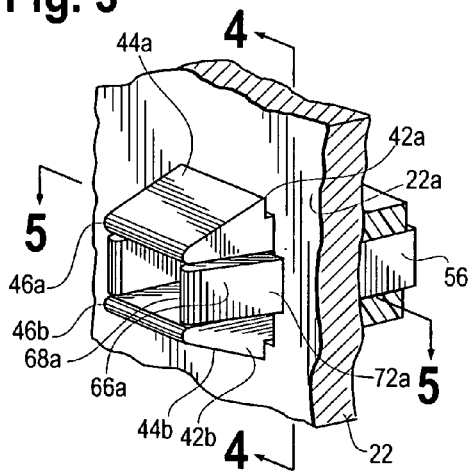
FIG. 3 is the partial perspective illustration of FIG. 2 with the mounting element and wedge mounted to the portion of a supporting structure.
Figure 4:
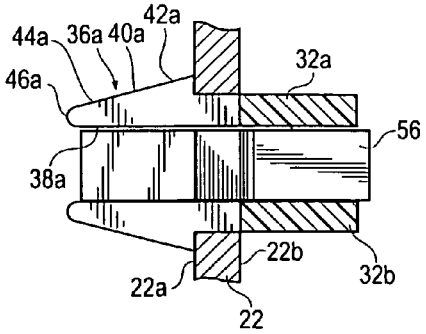
FIG. 4 is a cross-sectional view taken along the plane marked 4—4 in FIG. 3.
Figure 5:
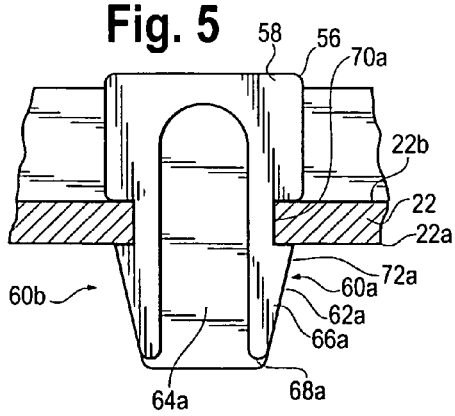
FIG. 5 is a cross-sectional view taken along the plane marked 5—5 in FIG. 3.

While the present invention is susceptible of embodiment in various forms, there is shown in the drawings and will hereinafter be described some embodiments with the understanding that the present disclosure is to be considered an exemplification of the invention and is not intended to limit the invention to the specific embodiments illustrated.

It should be understood that the title of this section of this specification, namely, "Detailed Description Of The Invention", relates to a requirement of the United States Patent Office, and does not imply, nor should be inferred to limit the subject matter disclosed herein.

Referring now to the figures, and in particular to FIG. 1, there is shown one embodiment of a mounting system 10 with a wedge 12 in accordance with the principles of the present invention. Such a system 10 permits readily mounting, for example, a sign S having a hinged or other mount 14 to a support structure, such as the vertical posts or uprights 16 of a storage (pallet) rack system 18.

As seen in FIG. 1, a portion of the supporting structure (e.g., the rack upright 16) has an opening 20 formed in a wall 22 thereof. The wall 22 is defined by inner and outer wall surfaces, 22*a,b*, respectively. In this embodiment, the opening 20 is shown as a square. However, the opening 20 can be other suitable shapes and sizes, as is known in the art, such as, e.g., rectangular or teardrop. The exemplary mount 14 includes a first fixed or mounting portion 24 and a second pivoting portion 26 that are connected to one another by a pivot pin 28. The mount and pivot portions 24, 26 can be connected in myriad ways as will be appreciated by those skilled in the art, including those shown in the aforementioned application Ser. No. 10/680,909 to Padiak et al. Preferably these portions are fabricated and manufactured easily and inexpensively. In a preferred embodiment, the pivot portion 26 is secured to a mountable object (not shown), such as, e.g., a sign, display or other suitable object by a fastener, such as a screw through an opening 30 in the pivoting portion 26, or by an adhesive, clips, hooks or the like.

As is known in the art, the mount portion 24 can include a pair of mounting extensions or fingers 32*a,b* that extend rearwardly from the body 34 of the mount portion 24. Each of the mounting fingers 32*a,b* includes a rearwardly extending wall 36*a,b* having inwardly facing surfaces 38*a,b* that are spaced from one another so that the inwardly facing surfaces 38*a,b* oppose each other. Each finger 32*a,b* also has an outward facing surface 40*a,b* that has a lip or barb 42*a,b* formed thereon. Preferably, the surface 44*a,b* between the end of the finger 46*a,b* and the barb 42*a,b* is inclined. The fingers 32*a,b*, along with the edges of the body between the fingers as indicated at 48, define an opening 50 in the body 34.

The fingers 32*a,b* are configured for insertion into the opening 20 in the upright (support) 16 such that the outwardly facing surfaces 40*a,b* engage opposite sides of the opening 20. In this manner, the barbs 42*a,b* engage the opposite edges of the opening 20 and secure the hinge 14 to the post 16. The barbs 42*a,b* engage the support opening 20 at an inner surface 22*a* of the wall 22 at the opening 50 when the mount body 34 rests on the outside surface 22*b* of the post 16. In this manner, the wall 22 that defines the opening 20 is "sandwiched" between the barb 42*a,b* and the mount body 34. In that the hinge 14 is formed from a polymer, the fingers 32*a,b* are typically flexible and are readily inserted into the opening 20 with the inclined surfaces 44*a,b* facilitating insertion and receipt of the fingers 32*a,b* in the opening 20. The fingers 32*a,b* can be flexed inward to release or disengage the fingers 32*a,b* from the post wall 22 to remove the mount 14 from the post 16.

A locking wedge 56 is positioned in the mount opening 50. The wedge 56 has a base 58 and a pair of legs 60*a,b* extending or depending from the base 58. The legs 60*a,b*, which are connected to one another by the base 58, have an outer wall 62*a,b* and an inner wall 64*a,b*. The outer walls 62*a,b* each include an inclined surface 66*a,b* extending from a free end 68*a,b* of the leg toward the base 58.

The legs 60*a,b* each include a notch or channel 70*a,b* formed in the outer wall 62*a,b*, between the base 58 and the free end 68*a,b*. The notches 70*a,b*, along with the inclined outer wall 66*a,b* define a lip or barb 72*a,b* on the leg 60*a,b*. The notches 72*a,b* are configured to engage the post wall 22 when the wedge 56 is inserted into the mount opening 50. The barbs 72*a,b* are disposed to retain the wedge 56 in position in the mount opening 50 and engaged with the post wall 22 when the wedge 56 is inserted into the mount opening 50.

As will be appreciated by those skilled in the art, the wedge 56 is inserted into the mount opening 50 and into the post opening 20. The wedge legs 60*a,b* lock into place in the post 16 by engagement of the notches 72*a,b* with the post wall 22. In addition, the wedge 56 fits snug up against the mount fingers 32*a,b* and interferes with inward flexing of the fingers 32*a,b*. As such, the wedge 56 prevents loosening of the mount 14 by preventing the mount fingers 32*a,b* from flexing inward and coming free from the post 16.

The hinge 14 and wedge 56 are formed from polymeric materials, such as high density polyethylene, polypropylene and the like, and are formed as injection molded parts. Other materials and processes for using and molding these materials will be recognized and appreciated by those skilled in the art.

All patents referred to herein, are hereby incorporated herein by reference, whether or not specifically done so within the text of this disclosure.

In the disclosures, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A mount for securing an associated object to a supporting structure, the supporting structure having a wall defining an opening therein, the wall having an outer surface and an inner surface, the mount comprising:

a mounting element adapted to receive the object, the mounting element having a body, the body having an opening therein defined by edges and having a predetermined shape, the body having a pair of resilient fingers extending rearwardly from the body, the fingers defining portions of the edges of the opening in the body, a wedge having a base and a pair of resilient legs depending from the base, the wedge having a predetermined shape adapted for receipt in the body opening, the legs each having a notch formed therein, a pivoting portion mounted to the mounting element;

wherein the mounting element is positioned with the resilient fingers in the supporting structure wall opening with the fingers locked to the supporting structure wall and wherein the wedge is received in the body opening to interfere with the mounting element fingers flexing inward and to secure the mounting element to the support structure.

2. The mount in accordance with claim 1 wherein each of the mounting element resilient fingers have an inclined surface extending from a free end of the finger toward the body.

3. The mount in accordance with claim 2 wherein the inclined surfaces each define a barb on the finger.

4. The mount in accordance with claim 1 wherein the wedge legs each include a channel formed therein between the base and a free end of each leg.

5. The mount in accordance with claim 4 including an inclined surface formed on each leg extending from the free end and forming a lip of the channel.

6. The mount in accordance with claim 1 wherein the opening in the body is rectangular and wherein the wedge has a rectangular cross-sectional shape for mating receipt in the rectangular opening.

7. The mount in accordance with claim 6 wherein the fingers are disposed on opposite sides of the rectangular opening and wherein the wedge is disposed in the opening between the fingers.

8. The mount in accordance with claim 1 including a pivot pin mounting the pivoting portion to the mounting element.

9. A mount for securing an associated object to a supporting structure, the supporting structure having a wall defining an opening therein, the wall having an outer surface and an inner surface, the mount comprising:

a mounting element adapted to receive the object, the mounting element having a body, the body having an opening therein defined by edges and having a predetermined shape, the body having a pair of resilient fingers extending rearwardly from the body, the fingers defining portions of the edges of the opening in the body, an interference member configured for receipt in the body opening and locking to the supporting structure wall, the interference member adapted for snuggle fitting between the mounting element resilient fingers;

the interference member comprising a pair of flexible legs;

each of the legs comprising a channel for engaging the channel directly to the supporting structure wall.

10. The mount in accordance with claim 9 wherein the resilient fingers and the interference member each include a barb formed at about an end thereof for securing the mounting element and the interference member to the supporting structure wall.

11. The mount in accordance with claim 9 wherein the channel is configured so as to define an edge of a barb.

12. The mount in accordance with claim 11 wherein the resilient fingers each include a barb at about an end thereof.

13. The mount in accordance with claim 12 wherein the barbs are flexible inwardly and wherein the interference member is positioned between the fingers, at the barbs, to prevent inward flexing of the barbs.

* * * * *